United States Patent [19]

Omata et al.

[11] Patent Number: 4,612,095

[45] Date of Patent: Sep. 16, 1986

[54] METHOD FOR IMPROVING CORROSION RESISTANCE OF BRIGHT ANNEALED STAINLESS STEEL

[75] Inventors: Hiroyasu Omata; Satoshi Ito; Tomomi Murata, all of Kawasaki, Japan

[73] Assignee: Nippon Steel Corporation, Tokyo, Japan

[21] Appl. No.: 722,490

[22] Filed: Apr. 12, 1985

[30] Foreign Application Priority Data

Apr. 14, 1984 [JP] Japan ..... 59-73910

[51] Int. Cl.[4] ..... C25F 1/00

[52] U.S. Cl. ..... 204/144.5

[58] Field of Search ..... 204/144.5, 145 R

[56] References Cited

U.S. PATENT DOCUMENTS 3,287,237 11/1966 Wilton ..... 204/145 R
4,129,485 12/1978 Shikata ..... 204/144.5

FOREIGN PATENT DOCUMENTS 2431554 7/1978 France ..... 204/144.5
59-23882 7/1984 Japan ..... 204/144.5

*Primary Examiner*—T. M. Tufariello
*Attorney, Agent, or Firm*—Pollock, Vande Sande & Priddy

[57] ABSTRACT

A method for improving corrosion resistance of bright annealed stainless steel is provided, in which the bright annealed stainless steel is subjected to alternating electrolysis in an aqueous nitric acid solution having a nitric acid concentration of 7 weight % or less in such a way that the stainless steel treated become an anode at least twice with the anode in the final run of electrolysis.

12 Claims, 2 Drawing Figures

METHOD FOR IMPROVING CORROSION RESISTANCE OF BRIGHT ANNEALED STAINLESS STEEL

BACKGROUND OF THE INVENTION

This invention relates to a method for improving corrosion resistance of bright annealed stainless steel.

Generally, stainless steel stock is first hot rolled and coiled and then, if desired, subjected to various treatments such as cold rolling, annealing, pickling, etc., and further subjected to surface finish to give surface luster or a specular surface or to form an abrasive pattern on the surface depending on the purposes of use of the product. For instance, "2D finish" is a finishing formula in which merely annealing and pickling are conducted after cold rolling. This finish gives a surface with a silver white luster and a product suitable for deep-draw working, and the worked product may be further subjected to polishing or buffing. 2D-finished stainless steel can be applied to various uses such as structural parts of aircraft, roof troughs, heat exchangers, etc. "2B finish" is a kind of luster finish which involves cold work of so slight a degree as for example, about 1–2% working, by polishing rolls after 2D finish. This finish is best suited for deep drawing of not so strict specifications. 2B-finished stainless steel is used for hospital furnishings, milk tanks, cooking utensils, tableware, building materials, and so on.

Bright annealing finish is carried out by annealing in a furnace in an inert atmosphere (usually ammonia cracked gas) after cold rolling and a succeeding cold work by polishing rolls, whereby a very beautiful surface can be obtained. Bright annealed stainless steel is used as various kinds of ornaments and articles which are not affected in their beautiful surface appearance by a slight degree of working. There exist various finishing methods for stainless steel other than those mentioned above.

As stated above, bright annealed stainless steel has beautiful surfaces and is widely used for automobile parts, bicycle parts, domestic electrical appliances, cooking utensils, construction materials, etc. However, corrosion resistance of the surface film formed by such bright annealing is unsatisfactory, especially in the case of ferritic stainless steel, and such bright anneal finished stainless steel product tends to be inferior in corrosion resistance to the product which has been abrasion finished with emery paper or other means. Therefore, in certain use environments, it is required that such bright anneal finished stainless steel be improved in its surface properties to have higher corrosion resistance.

Passivation of stainless steel by nitric acid immersion is often practiced for the purpose of improving corrosion resistance and normally by dipping in a 10–30 weight % nitric acid bath for 30 minutes–5 hours in laboratory tests. This can be applied to bright annealed stainless steel, and indeed an improvement of its corrosion resistance is provided by such nitric acid immersion. However, since the film formed by bright annealing is an oxide film of approximately 50 Å in thickness formed under a high temperature, the improvement of properties cannot be achieved to a satisfactory level by simple immersion in nitric acid. Especially when it is tried to improve corrosion resistance of stainless steel bright annealed in an industrial production line, such nitric acid immersion scarecely improve the corrosion resistance because of the difficulty to secure a nitric acid immersion bath operable with so long a period of time as mentioned above in prior arts and thus limited immersion time under current practice.

The present inventors have previously developed "a method for the passivation of bright annealed stainless steel" (Japanese Patent KOKAI (Laid-Open No. 23882/84). According to this method, bright annealed stainless steel is first subjected to electrolysis and then immersed in nitric acid. This method has a noticeable effect of improving corrosion resistance of said stainless steel, but since an immersion step is required, a lengthy nitric acid tank is needed as an on-line equipment. For instance, in the combined process of electrolysis and immersion at line speed of 15 m/min and immersion time of 1 minute, the length of the nitric acid tank required for the immersion step is 15 m and that required for the electrolysis is 5 m, and thus a nitric acid tank with a total length of 20 m is required for accomplishing said process. This process requires the provision of a 4 times longer nitric acid tank than that required in the case of electrolysis alone, and the treating time is also long. Naturally, the amount of nitric acid used for filling the nitric acid tank is large, and, further, since a nitric acid solution of a higher nitric acid concentration has a higher improvement, the amount of nitric acid required is greater than that seemingly assumed, and also the amount of $NO_x$ produced during the treatment is relatively large and additional countermeasure efforts therefor are required.

In the method of the abovementioned Patent KOKAI (Laid-Open), alternating electrolysis is conducted at a current density of 5–300 mA/cm$^2$, a liquid temperature of from normal temperature to 80° C. and a wide nitric acid concentration range of 5–30 weight %. It has been considered essential to this method that the product is immersed in a nitric acid solution having a nitric acid concentration of not less than 10 weight %.

Nitric acid electrolysis is sometimes used for the purpose of descaling after annealing of products to be 2B-finished or 2D-finished, not of the product to be bright anneal finished, in the stainless steel production process, but in this case, since a higher concentration of nitric acid produces a greater descaling effect, the nitric acid concentration used is generally as high as 7–15 weight %, and further it is not intended to improve corrosion resistance.

SUMMARY OF THE INVENTION

The object of the present invention is to provide a method for improving surface corrosion resistance of bright annealed stainless steel.

As a result of further researches on the subject matter, the present inventors have reached the conclusion that alternating electrolysis in a low-concentration nitric acid solution is an industrially, very useful method for the object as mentioned above. It has been found that in a low-concentration nitric acid solution, it is possible to preferentially dissolve iron and manganese, which are the undesirable film components of bright annealed stainless steel for subsequent passivation in obtaining an excellent corrosion-resistant surface only by nitric acid electrolysis without requiring any nitric acid immersion treatment. According to the method of this invention, it is possible to reduce the required length of a nitric acid tank and to accordingly shorten the treating time, and thus this method is an industrially very advantageous method.

According to the present invention, bright annealed stainless steel is subjected to alternating electrolysis in a low-concentration nitric acid solution in such a manner that the stainless steel will become an anode at least twice including the final run of electrolysis, to thereby improve corrosion resistance of the bright annealed stainless steel.

The above-mentioned alternating electrolysis can be achieved in two ways: indirect electrolysis and direct electrolysis as described below.

The bright annealed stainless steel treated in accordance with the method of the present invention is broadly used for automobile parts, bicycle parts, domestic electrical appliances, cooking utensils, construction materials, exterior and interior ornaments, furnishings and the like, particularly as exterior or interior automobile parts such as mouldings or trimmings for garnishing automobiles.

DETAILED DESCRIPTION OF PREFERRED EMBODIMENTS

In case of anodic electrolysis only films on certain crystal grains or along grain boundaries are selectively dissolved while films on the rest of the grains are scarcely dissolved. As a result, anneal finish tends to lose its beautiful surface appearance and corrosion resistance as well.

In order to solve this problem, the present invention provides a process featured by the practice of alternating electrolysis in a low-concentration nitric acid solution, whereby, among the surface film composing elements, iron and manganese which are not beneficial elements for a stable passive state are preferentially dissolved in the dilute nitric acid solution as a weak passivating agent, so that a stable surface film enriched with such elements as chromium, silicon, etc., is formed. The nitric acid concentration in the solution should be 7 weight % or less, where the passivating action of nitric acid is weak.

Figure 1:
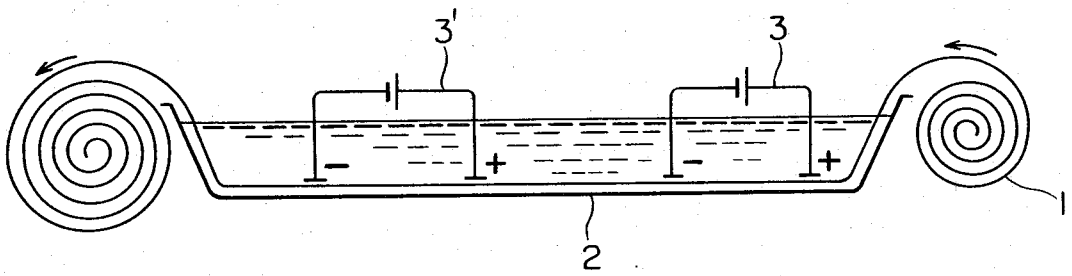
FIG. 1 is a schematic illustration for the indirect electrolysis method in nitric acid according to this invention.
Figure 2:
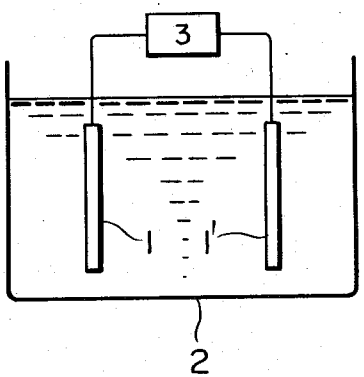
FIG. 2 is a schematic illustration for the direct electrolysis method in nitric acid according to this invention.

There are two typical methods for electrolysis in a nitric acid solution according to this invention. One of them is an indirect alternating electrolysis method illustrated in FIG. 1. According to this method, a coiled strip of bright annealed stainless steel 1 is allowed to continuously pass through an acid bath 2 in which at least two pairs 3,3′ of an anode and a cathode are installed adjacent to the strip traveling through the bath so that the strip acts as an indirect cathode when it is positioned close to the anode and acts as an indirect anode when it is close to the cathode. Thus, the strip undergoes a cathode treatment and an anode treatment alternately as it passes through the bath. FIG. 1 shows that only one side of a stainless steel strip is treated, but both the sides of the strip may be treated by installing such electrodes at both the sides. Another method is a direct alternating electrolysis method illustrated in FIG. 2. This method can be applied to a bright annealed stainless steel article which is not in the form of a continuous strip but in the form of a cut plate, bar, rod or the like. According to this method, stainless steel article 1 to be subjected to the electrolysis treatment is connected to a power source 3 so that the stainless steel article itself serves as an electrode, and the electrolysis is carried out in a low-concentration nitric acid bath 2 while alternately changing the polarities of the stainless steel article 1 and an opposing electrode 1′.

The dissolution behavior of a given stainless steel during the alternating electrolysis is quite specific. In the initial anodic electrolysis, films on certain crystal grains or along grain boundaries are selectively dissolved. But according to the process of this invention, a pause is given after the anodic electrolysis, followed by a cathodic electrolysis. This pause is helpful for inducing passivation of the dissolved area and bringing it to a more noble potential than that of non-dissolved area so that the passivated area will not be dissolved preferencially in the next run of anodic electrolysis. Repetition of such alternating anodic and cathodic electrolyses can effectuate the uniform dissolution of the entire surface. Also, in the course of cathodic electrolysis, the near surface oxide film of bright annealed stainless steel is partially reduced.

As to the polarity of bright annealed stainless steel in the alternating electrolysis according to this invention, it may start with either negative (−) or positive (+), but it should finally become positive (+), and also it should become positive (+) at least twice in the process. The duration of electrolysis is 0.2–10 seconds for each polarity, with the total time being not longer than 120 seconds. The shorter the application time for each polarity, the more effective the process from an industrial point of view. The current density should be 5–300 $mA/cm^2$ and the liquid temperature should be within ambient temperature to 80° C. The nitric acid concentration should be not greater than 7 weight %, preferably 1–7 weight %, more preferably 2–5 weight %, the best being about 4 weight %.

This invention will be further described below in accordance with the embodiments thereof.

EXAMPLES

Bright annealed stainless steel SUS 430 was subjected to alternating electrolysis in the low-concentration nitric acid solutions under the conditions shown in Table 1. The results of rust resistance test and exposure test are also shown in Table 1.

It is clear from Table 1 that stainless steel which has undergone the low-concentration nitric acid electrolysis is far superior in corrosion resistance to stainless steel as simply bright annealed.

Analysis of surface film compositions of stainless steel specimens of Run Nos. 3 and 16 by Auger electron spectroscopy showed that the atomic ratio of chromium+silicon to iron+manganese in the film, i.e., (Cr+Si)/(Fe+Mn) was 2.3 in stainless steel as bright annealed to Run No. 16 whereas it was 4.7 in the electrolysis-treated stainless steel of Run No. 3, indicating a prominent enrichment of chromium and silicon in the surface film of the latter steel. It is well known that chromium contributes greatly to the corrosion resistance of stainless steel. As regards silicon, the present inventors examined the relation between the surface film composition and corrosion resistance of bright annealed stainless steel and found that silicon has even greater effect of improving corrosion resistance, particularly resistance to atmospheric corrosion than chromium in the surface film of bright annealed stainless steel. This indicates that the stainless steel which has been subjected to the low-concentration nitric acid electrolysis treatment according to this invention has a very excellent corrosion resistance.

The rust resistance test and exposure test in the Examples were conducted as described below.

Rust resistance test:

A 30–100 μm thick layer of a 0.5 M NaCl solution was allowed to stay still with the aid of a gauze, through which wicking of solution occurs on the surface of stainless steel which was left in a box of 55% humidity while measuring the electric potential of the surface to determine the time which passed till a potential drop was caused by the generation of rust. This test procedure is disclosed in S. Ito et al, "Atmospheric Corrosion of Stainless Steels", Passivity of Metals and Semiconductors, Proceedings of the Fifth International Symposium on Passivity, Bombannes, France, May 30–June 3, 1983, Organized by the Sociéte Chimie Physique, edited by M. Forment, Elservier Science Publishers B.V., Amsterdam, 1983.

Exposure test:

Each sample of stainless steel was left stationary at the seashore for 3 weeks and the state of rusting on the surface of the sample was observed. The result was rated according to the following three-grade rating:

◎ Free of rust.
○ Slightly rusted.
× Heavily rusted.

1. A method for improving corrosion resistance of bright annealed stainless steel, which comprises subjecting said stainless steel to alternating electrolysis in an aqueous nitric acid solution having a nitric acid concentration 1 to 7 weight % in such a manner that said stainless steel acts as an anode at least twice with the anode in the final run of electrolysis.

2. The method according to claim 1, wherein the nitric acid concentration is about 4% by weight.

3. The method according to claim 1, wherein the nitric acid concentration is 2–5% by weight.

4. The method according to claim 1, wherein the alternating electrolysis is carried out for a period of time of electric current application for each polarity of 0.2–10 seconds, the total time of the application being 120 seconds or less at a current density of 5–300 mA/cm$^2$ and a liquid temperature of from ambient temperature to 80° C.

5. The method according to claim 4, wherein the nitric acid concentration is about 4% by weight.

6. The method according to claim 4, wherein the nitric acid concentration is 2–5% by weight.

7. The method according to claim 1, wherein the alternating electrolysis is an indirect alternating one.

8. The method according to claim 1, wherein the alternating electrolysis is a direct alternating one.

9. The method according to claim 4, wherein the alternating electrolysis is an indirect alternating one.

TABLE 1

| | Tested stainless steel: SUS 430 | | | | | | | | | | | |
|---|---|---|---|---|---|---|---|---|---|---|---|---|
| | Low-concentration nitric acid electrolysis treatment | | | | | | | | | | Rust resistance test | |
| | | Electrification pattern × number of times of repetition | | | | | | | | | | |
| Run No. | Concentration (wt. %) | Cathode (sec.) | Pause (sec.) | Anode (sec.) | Pause (sec.) | | Current density (mA/cm$^2$) | Liquid temperature (°C.) | Time passed till rust was formed (hr) | Exposure test Judgment |
| 1 | 2 | (2 - | 3 - | 2 - | 3) | × 2 | 25 | 40 | 139 | ◎ |
| 2 | 3 | (2 - | 3 - | 2 - | 3) | × 2 | " | " | 148 | ◎ |
| 3 | 4 | (2 - | 3 - | 2 - | 3) | × 2 | " | " | 156 | ◎ |
| 4 | 4 | (2 - | 3 - | 2 - | 3) | × 2 | " | 20 | 153 | ◎ |
| 5 | 4 | (2 - | 3 - | 2 - | 3) | × 2 | " | 70 | 156 | ◎ |
| 6 | 4 | (2 - | 3 - | 2 - | 3) | × 4 | " | 40 | 161 | ◎ |
| 7 | 4 | (2 - | 3 - | 2 - | 3) | × 2 | 10 | " | 152 | ◎ |
| 8 | 4 | (2 - | 3 - | 2 - | 3) | × 2 | 60 | " | 157 | ◎ |
| 9 | 4 | (2 - | 3 - | 2 - | 3) | × 2 | 250 | " | 158 | ◎ |
| 10 | 5 | (2 - | 3 - | 2 - | 3) | × 2 | 25 | " | 136 | ◎ |
| 11 | 6 | (2 - | 3 - | 2 - | 3) | × 2 | " | " | 133 | ◎ |
| 12 | 7 | (2 - | 3 - | 2 - | 3) | × 2 | " | " | 125 | ○ |
| 13 | 8 | (High-concentration region) | | | | | " | " | 119 | ○ |
| | | (2 - | 3 - | 2 - | 3) | × 2 | | | | |
| 14 | 10 | (High-concentration region) | | | | | " | " | 117 | ○ |
| | | (2 - | 3 - | 2 - | 3) | × 2 | | | | |
| 15 | 15 | (High-concentration region) | | | | | " | " | 113 | ○ |
| | | (2 - | 3 - | 2 - | 3) | × 2 | | | | |
| 16 | 30 | (High-concentration region) | | | | | " | " | 110 | ○ |
| | | (2 - | 3 - | 2 - | 3) | × 2 | | | | |
| 17 | Comparative sample 1: | Anodic electrolysis in 4 wt. % $HNO_3$ at 40° C. (25 mA/cm$^2$, 4 sec.) | | | | | | | 89 | x – ○ |
| 18 | Comparative sample 2: | No treatment. | | | | | | | 68 | x |

As described above, the present invention makes it possible to improve corrosion resistance of bright annealed stainless steel only by a short-time alternating electrolysis treatment in a low-concentration nitric acid solution with minimized generation of $NO_x$. Thus, the present invention is of extremely high industrial value.

What is claimed is:

10. The method according to claim 4, wherein the alternating electrolysis is a direct alternating one.

11. A highly corrosion-resistant bright annealed stainless steel obtained according to the method of claim 1.

12. A highly corrosion-resistant bright annealed stainless steel obtained according to the method of claim 4.

* * * * *